US006554273B1

(12) United States Patent
Holland-Letz et al.

(10) Patent No.: US 6,554,273 B1
(45) Date of Patent: Apr. 29, 2003

(54) METHOD AND DEVICE FOR FORMING A WAD OF INDIVIDUAL SHEETS

(75) Inventors: Günter Holland-Letz, Paderborn (DE); Markus Gummich, Augustdorf (DE)

(73) Assignee: Wincor Nixdorf GmbH & Co. KG, Paderborn (DE)

( * ) Notice: Subject to any disclaimer, the term of this patent is extended or adjusted under 35 U.S.C. 154(b) by 0 days.

(21) Appl. No.: 09/890,245

(22) PCT Filed: Feb. 2, 2000

(86) PCT No.: PCT/DE00/00321

§ 371 (c)(1),
(2), (4) Date: Jul. 27, 2001

(87) PCT Pub. No.: WO00/46137

PCT Pub. Date: Aug. 10, 2000

(30) Foreign Application Priority Data

Feb. 5, 1999 (DE) ..... 199 04 853

(51) Int. Cl.[7] ..... B65H 43/00
(52) U.S. Cl. ..... 271/176; 271/187; 271/315
(58) Field of Search ..... 271/176, 187, 271/315

(56) References Cited

U.S. PATENT DOCUMENTS

| | | | | |
|---|---|---|---|---|
| 3,531,108 A | | 9/1970 | Rabinow et al. | 271/64 |
| 4,331,328 A | | 5/1982 | Fasig | 271/270 |
| 4,787,620 A | | 11/1988 | Goldkuhle | 271/111 |
| 5,641,156 A | | 6/1997 | Nukada et al. | 271/176 |
| 5,803,705 A | * | 9/1998 | Keyes | 271/187 X |
| 6,354,591 B1 | * | 3/2002 | d'Agrella | 271/315 |

FOREIGN PATENT DOCUMENTS

| | | | |
|---|---|---|---|
| DE | 689 08 276 | 3/1994 | B65H/7/12 |
| DE | 197 57 421 | 10/1999 | G07F/7/08 |
| EP | 0 308 057 | 3/1989 | B65H/29/40 |
| EP | 0 744 718 | 11/1996 | G07D/11/00 |
| FR | 2 664 581 | 7/1990 | B65H/29/40 |
| GB | 2 168 686 | 6/1985 | B65H/29/40 |
| GB | 2 168 687 | 6/1986 | B65H/43/00 |
| GB | 2 301 092 | 11/1996 | B65H/29/40 |
| JP | 61 150959 A | 9/1986 | B65H/29/40 |
| JP | 61 150959 AA | 9/1986 | B65H/29/40 |
| WO | WO 83/00136 | 1/1983 | B65H/29/40 |

OTHER PUBLICATIONS

J.L. Nonday: "Tined Stacker Wheel" IBM Technical Disclosure Bulletin, vol. 18, No. 7, Dec. 1975, pp. 2273–2274.

* cited by examiner

*Primary Examiner*—David H. Bollinger
(74) *Attorney, Agent, or Firm*—McCormick, Paulding & Huber LLP

(57) ABSTRACT

In the case of a method of, and an apparatus for, forming a bundle of individual sheets, in particular banknotes (98), which are drawn off individually from a sheet-storage container, fed, via a sheet conveyor (14), to a stacking-wheel arrangement (16) comprising at least one stacking wheel, and set down on a stacking surface by means of said stacking-wheel arrangement, the stacking wheel (58) is driven intermittently and controlled such that a receiving gap (90) of a stacking wheel is aligned with the outlet end (44) of the sheet conveyor (14) when a sheet (98) leaves the sheet conveyor (14). The trailing edge of a sheet (98) leaving the sheet conveyor (14) is detected at a predetermined location of the sheet conveyor (14), and the stacking wheel is advanced by one receiving gap (90) in dependence on the time at which the trailing edge is detected.

20 Claims, 3 Drawing Sheets

METHOD AND DEVICE FOR FORMING A WAD OF INDIVIDUAL SHEETS

Figure 1:
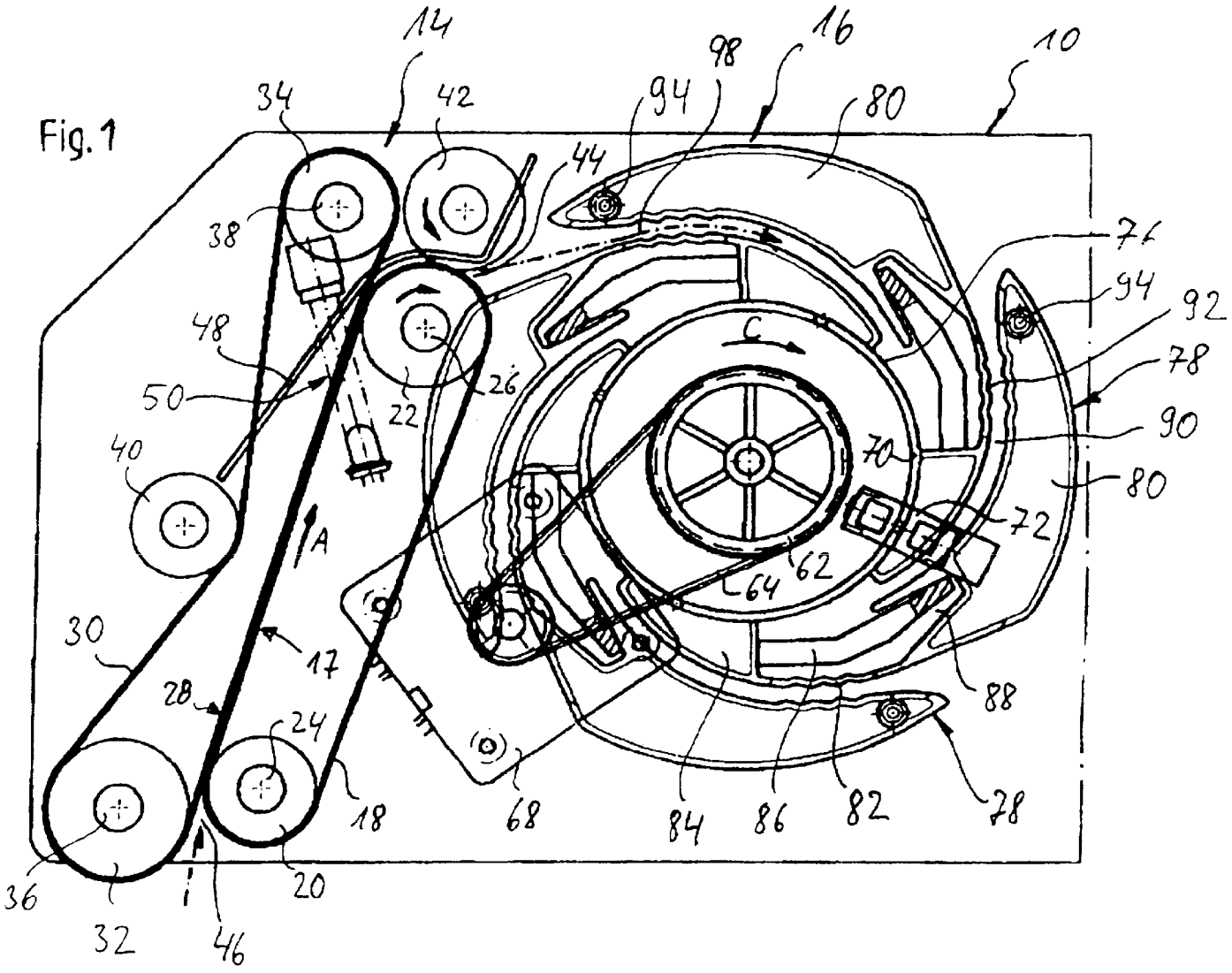

The invention relates to a method of forming a bundle of individual sheets according to the preamble of claim 1.

It is normally the case that, for the bundle-forming operation, banknotes are discharged from the separating mechanism to a transporting device at uniform spacings. With notes which are difficult to separate, the frictional drawing-off means of the separating mechanism is not always capable of delivering the notes in a uniformly separated manner.

It is then possible for all kinds of incorrect drawing-off operations to take place with banknotes which overlap in a flush manner, in imbricated form or even just in the edge region and with banknotes which follow one after the other at different spacings.

A series of sheets with irregular spacings or banknotes which overlap one another at a number of locations result in problems in terms of the sheets or banknotes being set down by the stacking wheel. The conventional stacking wheel has a multiplicity of closely adjacent paddles which form circle-arc-shaped slots with tangentially directed inlet openings, into which in each case one banknote is pushed. The action of pushing the banknotes into the continuously circulating stacking wheel generally does not pose any problems since the circumferential speed of the stacking wheel is very much slower than the transporting speed of the banknotes supplied. Since the paddles of the stacking wheel, furthermore, are very thin at their ends, there is no risk, in practice, of the banknotes striking against a paddle tip and thus being deflected from the path in their entirety.

With the correctly selected arrangement of the sheet conveyor and stacking wheel and with the correct relative speed, individually arriving notes are thus generally processed in a very reliable manner. If, however, the banknotes overlap or the spacing between them is too small, this may result in the banknotes no longer passing into the stacking-wheel gap and overshooting the stacking wheel into the set-down space. (It is possible here, in some circumstances, for the banknotes not to be gripped by the advancing conveyor and to remain in the transporting module.

With the correct arrangement, even overlapping banknotes may, if appropriate, still pass into the stacking wheel and be set down on the bundle. The arrangement here must be such that the following sheet or the following banknote is pushed beneath the banknote which is already located in the stacking wheel. If, on the other hand, the imbrication is the other way round, then the following sheet lifts up from the sheet running into the stacking wheel and overshoots the stacking wheel. The type of imbrication depends on the course of the transporting path between the separating apparatus and the stacking-wheel arrangement.

If the spacings between the sheets or banknotes are too short, this may result in a collision between the trailing edge of the banknote which has already run into the stacking wheel and the quickly following banknote, which is thus likewise deflected such that it shoots past the stacking wheel.

The object of the invention is to specify a method of the type mentioned in the introduction by means of which bundles of individual sheets can be formed reliably even when these individual sheets overlap wholly or partially or the spacing between two successive sheets is smaller than the minimum spacing which is necessary for normal operation.

This object is achieved according to the invention by the features specified in the characterizing part of claim 1.

In contrast to the known solution, in which the stacking wheel circulates continuously, the stacking wheel of the solution according to the invention is at a standstill when the sheet leaves the sheet conveyor and enters into the receiving gap of the stacking wheel. It is thus also possible for a plurality of overlapping sheets to be introduced into the same receiving gap of the stacking wheel, since the latter is only advanced when the trailing edge of the sheet leaving the sheet conveyor, or of the group of overlapping sheets, is detected. With a suitable design of the stacking wheel, it is thus readily possible for up to four sheets or banknotes to be gripped in a receiving gap of a stacking wheel. Since the stacking wheel is at a standstill as the sheets run in, the direction of imbrication is of no significance, i.e. even overlapping notes pass reliably into the stacking wheel irrespective of whether the following sheet is located above or beneath the preceding sheet.

As the above description demonstrates, sheets with the normal spacing and overlapping sheets are handled in the same way since, in both cases, the stacking wheel is only advanced when a trailing edge of an individual sheet or of a group of sheets is detected.

If, on the other hand, the spacings are too short, additional measures are necessary. The spacings can be gathered from the possible transporting speed and the number of sheets which are to be transported per unit of time. The minimum spacing which is to be maintained can be gathered, inter alia, from the times for advancing the stacking wheel. In order to ensure that successively spaced-apart sheets also pass into successive receiving gaps of the stacking wheel, the invention proposes that the spacing between a preceding sheet and a following sheet is detected within the sheet conveyor, that, when the spacing is smaller than a predetermined minimum spacing, the operation of the sheets being drawn off individually from the sheet-storage container is interrupted and the transporting speed is reduced until the preceding sheet has left the sheet conveyor, that the drive of the sheet conveyor is then stopped, that, once the preceding sheet has run into the stacking wheel, the stacking wheel is advanced, and that the drive of the sheet conveyor is switched on again.

As long as the actual sheet spacings are smaller than the predetermined minimum spacing, in this case, when the sheet-conveyor drive is switched on, the latter is controlled such that the sheet conveyor is first of all accelerated only to a fraction of the nominal speed.

In order for it to be possible to establish which kinds of drawing-off errors are occurring, it is expedient for the sheet thickness and the extent of the sheet in the transporting direction to be detected in the region of the sheet conveyor. This makes it possible to establish how many sheets are overlapping, in what way, and to what extent, they are overlapping, and whether individual sheets are possibly directed obliquely in relation to one another.

The invention also relates to an apparatus for forming a bundle of individual sheets, in particular banknotes, which are drawn off individually from a sheet-storage container, in particular for implementing the abovedescribed method, comprising a separating apparatus for drawing off the sheets from the sheet-storage container, a sheet conveyor, a drive for the sheet conveyor, a stacking-wheel arrangement, which is assigned to the outlet end of the sheet conveyor and has at least one stacking wheel and a stacking-wheel drive, a detector device, which is arranged in the region of the sheet conveyor and is intended for detecting an edge of a sheet running through the sheet conveyor, and a control device, which is connected to the separating apparatus, the drive of the sheet conveyor, the stacking-wheel drive and the detector device.

According to the invention, the stacking-wheel drive is designed here for an intermittent drive, and the control device is programmed such that the stacking wheel is stopped in a position in which the receiving gap of the stacking wheel is aligned with the outlet end of the sheet conveyor when a sheet leaves the sheet conveyor, and that, in dependence on an output signal from the detector device, said signal corresponding to the trailing edge of a sheet running into the receiving gap of the stacking wheel being detected, the stacking wheel is advanced by one receiving gap.

As has already been mentioned above, this arrangement ensures that individual sheets with the correct spacing or overlapping sheets pass reliably into the receiving gap of the stacking wheel since the latter is only advanced when it has been ensured that the respective sheet or the respective group of sheets has passed into the receiving gap and has left the sheet conveyor.

In order for it to be possible to determine the spacings between the successive sheets, a spacing-measuring device is arranged in the region of the sheet conveyor. It is also possible, in principle, for this purpose to use the abovementioned detector device, which supplies an edge signal, with the result that, from successive edge signals and the known transporting speed, the control device can determine the spacing between two successive sheets.

The detector device may comprise here a light barrier, which is arranged in the vicinity of the outlet end of the sheet conveyor.

A thickness-measuring device is also preferably provided in the region of the sheet conveyor, in order to detect the thickness of the sheets running through the sheet conveyor, by way of which it is possible to establish, in particular, whether sheets are overlapping. This is also important during the dispensing operation of banknotes in order to establish, for example, whether just one note is being dispensed or two notes overlapping in a flush manner are being dispensed. The thickness-measuring device here may have, for example, a lever gauge which is mounted such that it can be pivoted in relation to a rigid rest and of which the pivoting movement is converted into a corresponding signal.

In order, finally, to establish whether two or more sheets are partially overlapping, a length-measuring device is expediently provided in the region of the sheet conveyor, this device detecting the extent in the transporting direction of the sheets running through the sheet conveyor. In conjunction with the thickness measurement, this makes it possible to ascertain how many sheets are overlapping and in what way. The length-measuring device here may comprise at least one sensor for detecting a sheet edge, and may also comprise an encoder which is coupled to the drive of the sheet conveyor, the transporting speed being determined by said encoder. The length-measuring device preferably has at least two sensors which are spaced apart transversely to the transporting direction, with the result that oblique positioning of a sheet may also be detected. Since the thickness-measuring device also detects the presence and absence of sheets, it may likewise be used for measuring spacing and length.

During the intermittent operation of the stacking wheel, there is the problem of the stacking wheel, for the desired throughput of sheets, having to be accelerated to a very great extent during the advancement operation. There is a risk here of the sheet pushed into the receiving gap of the stacking wheel not being carried along by the stacking wheel. In particular if the note spacings are too narrow, it may be the case that the banknotes are already partially overlapping. Since the action of intersecting edges being pushed one above the other may result in the sheets or banknotes getting caught, it is necessary in such cases for the sheets to be drawn apart from one another. It is possible here for the following banknote to rest on the trailing edge of the banknote which is already located in the stacking wheel and to secure this latter banknote during the advancement operation, with the result that the banknote which is already located in the receiving gap of the stacking wheel is drawn out again.

In order to prevent such an effect, the invention proposes that the stacking wheel has a wheel hub with more or less tangentially directed paddles which are articulated resiliently on said wheel hub and of which in each case two adjacent paddles form a receiving gap for a sheet, the majority of the paddle mass being concentrated in the half of the paddle which is in the vicinity of the free paddle end.

This design of the stacking wheel results in the situation where in the initial accelerating phase of the stacking wheel, during advancement of the same, an inwardly directed radial force component acts on the paddles, with the result that the latter swing radially inward. The receiving gap thus closes and the sheet which is already located in the receiving gap is clamped in and carried along. As the circumferential speed of the stacking wheel increases, the centrifugal forces predominate again, these forces moving the paddles in the radially outward direction and opening the receiving gap, with the result that, on the stacking surface, the sheets can easily be stripped from the receiving gap.

The abovedescribed pivoting movement of the paddles in the radially inward direction may be enhanced by an additional mass being arranged in the vicinity of the free end of the paddle, said additional mass being of a higher density than the stacking-wheel material. The stacking wheel itself may be produced, for example, in one piece from plastic, the articulation between the paddles and the wheel hub and also the elastic restoring force being provided by a material bridge and the material itself. In contrast, the additional mass may consist of a piece of metal.

In order to improve the gripping of the banknote which is located in the receiving gap by the paddles, the paddles may bear a corrugated formation on their mutually facing surfaces.

In a preferred embodiment, the stacking wheel has four paddles which are offset in each case through 90 in relation to one another. In order to avoid the paddles spreading too far apart on account of the centrifugal force, the resilient deflection of the paddles in the radially outward direction may be limited in each case by a stop which is connected rigidly to the hub.

A stepping motor is preferably used for the drive of the stacking wheel.

It should be emphasized that the abovedescribed design of the stacking wheel is also suitable for uses other than in automatic teller machines or the like.

Figure 2:
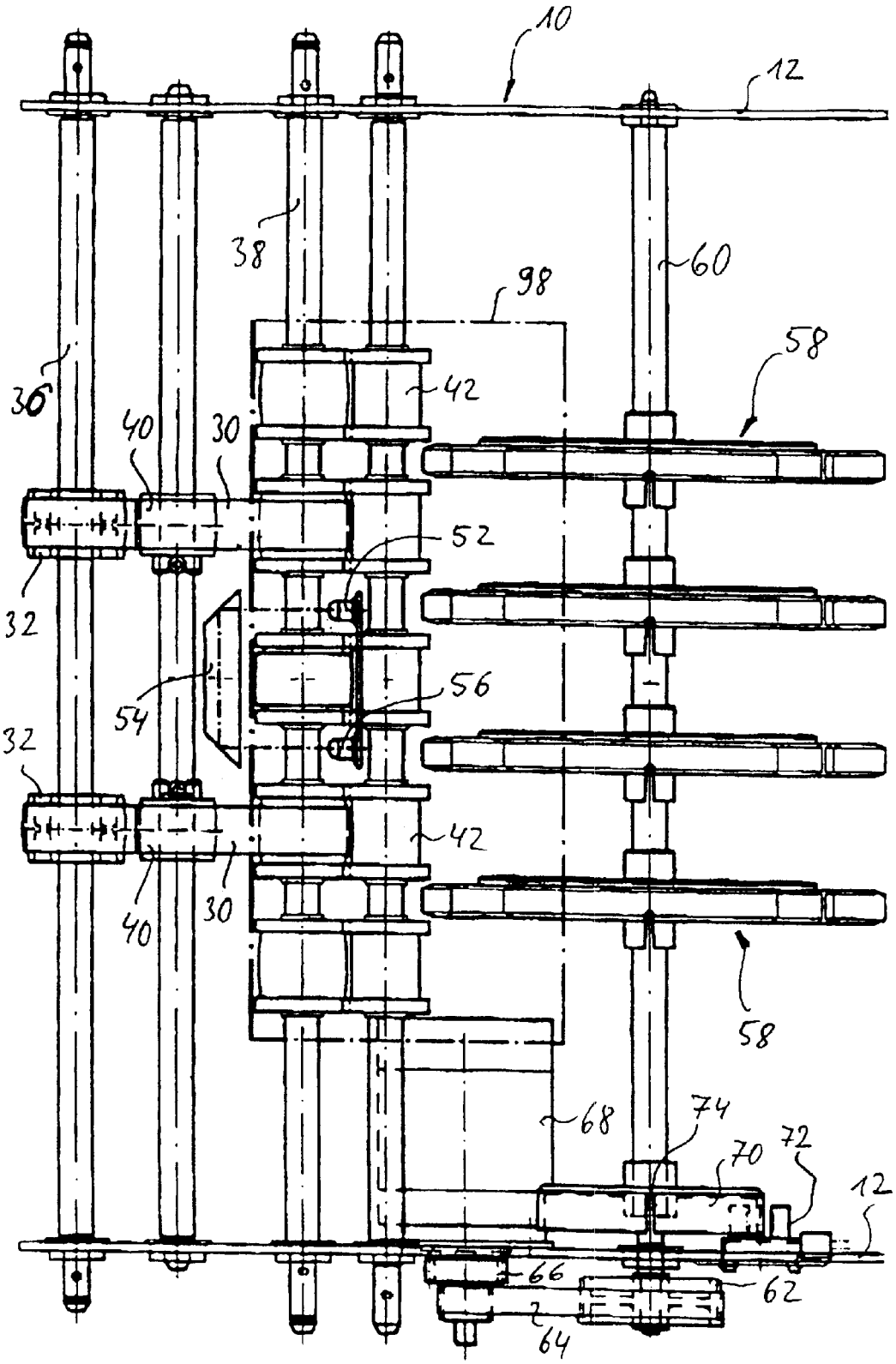
Figure 3:
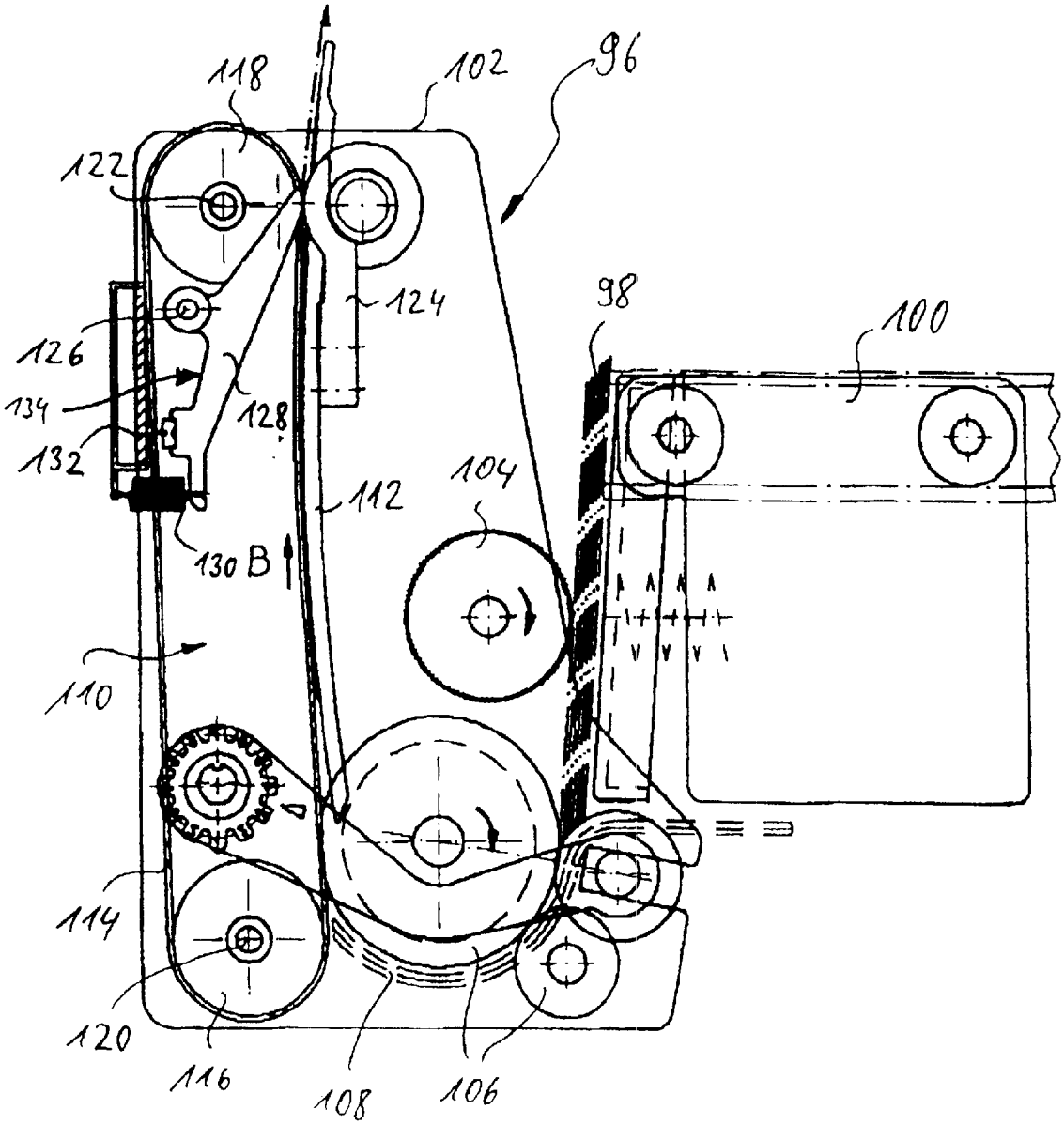

The following description, in conjunction with the attached drawings, explains the invention with reference to an exemplary embodiment. In the drawings:

FIG. 1 shows a schematic side view of a collector module with a sheet conveyor and a stacking-wheel arrangement, FIG. 2 shows a plan view of the module illustrated in FIG. 1, and FIG. 3 shows a schematic side view of a separating module for drawing off sheets from a sheet-storage container and for feeding the sheets to the collector module according to FIGS. 1 and 2.

The collector module, which is illustrated in FIGS. 1 and 2, comprises a frame 10 with side walls 12, between which a sheet conveyor 14 and a stacking-wheel arrangement 16 are arranged.

The sheet conveyor 14 has a first belt-pull mechanism 17 with endless belts 18, which are guided over rollers and 22. The latter are respectively seated on a shaft 24, 26, said shafts being mounted rotatably parallel to one another in the side walls 12 of the frame 10. The sheet conveyor 14 also comprises a second belt-pull mechanism 28 with endless belts 30, which are guided over rollers 32 and 34 which, for their part, are seated on shafts 36, 38 which, in turn, are mounted rotatably between the side walls 12 of the frame 10. The endless belts 30 are tensioned by a tensioning roller 40. The top rollers 22 of the first belt-pull mechanism 17 are assigned pressure-exerting rollers 42, which form an outlet gap 44 with the rollers 22.

At its bottom end, the transporting section formed by the first belt-pull mechanism 17 and the second belt-pull mechanism 28 has an inlet gap 46 for sheets or banknotes which are to be transported, said sheets or banknotes running through the sheet conveyor 14 in the direction of the arrow A and, at the top end of said conveyor, being deflected in the direction of the outlet gap 44 by a deflecting plate 48.

A light barrier 50 is arranged in the transporting path, in the vicinity of the outlet end of the sheet conveyor 14, and comprises a transmitting element 52, a deflecting element 54 and a receiving element 56. This makes it possible to detect the leading and trailing edges of sheets or banknotes running through.

The sheet conveyor 14 illustrated is driven via a drive motor (not illustrated) which acts on at least one of the shafts 24, 26, 36 and 38 via a suitable gear mechanism.

The stacking-wheel arrangement 16 comprises four stacking wheels 58, which[]are seated together on a shaft 60 which is mounted in the side walls 12 of the frame 10. At its bottom end in FIG. 2, the shaft 60 bears, outside the frame 10, a drive wheel 62 which is connected, via a drive belt 64, to the drive pinion 66 of a stepping motor 68, which drives the stacking-wheel arrangement 16. Also seated on the shaft 60 is a cup-like light-barrier wheel 70 which engages in a fork-type light barrier 72 by way of its cup border and has four slots 74 offset in each case through 90 in the cup border. This wheel 70 serves, with the aid of the fork-type light barrier 72, for positioning the stacking wheels 58 in a certain angle position.

Each stacking wheel 58 has a wheel hub 76 and four paddles 78, which extend essentially tangentially. The paddles 78 each have a high-mass section 80, which is connected to an extension 84, fixed to the wheel hub, via a thin material bridge 82, with the result that the paddles 78 can execute a pivoting movement in the radially inward direction or radially outward direction relative to the wheel hub 76. This pivoting movement is limited by a finger-like stop 86, which is connected rigidly to the extension 84 and engages in a pocket 88 at the rear end of the respective paddle section 80.

Formed between in each case two adjacent paddles 78 is a circle-arc-shaped receiving gap 90, which is intended for receiving one or more sheets. In order to improve the gripping of a sheet in the receiving gap 90, mutually facing surfaces of the paddles 78, which bound a receiving gap 90, have a corrugated or wave-form surface profile 92, as is indicated in FIG. 1. Additional masses in the form of pieces of metal 94 are arranged in the vicinity of the free ends of the paddles 78, while the individual stacking wheel 58 is produced, as a whole, in one piece from plastic.

FIG. 3 shows a separating module 96 for drawing off banknotes or sheets 98 from a banknote store 100, which is known per se and will not be explained in any more detail here. The separating module comprises a frame in which drawing-off rollers 104 and separating rollers 106 are mounted. The drawn-off banknotes 98 are deflected, by a directing plate 108, into a transporting section 110 which comprises a directing plate 112 and a belt conveyor with endless belts 114, which are guided over bottom rollers 116 and top rollers 118 which, for their part, are mounted on respective shafts 120 and 122 in the module frame 102. As far as the conveying operation of the banknotes is concerned, the transporting section 110 is to be added to the conveying path of the sheet conveyor 14.

A thickness-measuring device 134 is arranged in the vicinity of the top outlet end of the separating module 96, said thickness-measuring device having a rigid abutment 124 and a lever gauge 128 which can be moved in relation to said abutment, is mounted such that it can be pivoted about a spindle 126, is braced against the abutment 124 by a spring 130 and of which the deflection by one or more banknotes running through can be detected by a sensor 132.

The drive of the separating module 96 (said drive not being illustrated), the drive of the sheet conveyor 14, the stacking-wheel drive 68, the thickness-measuring device 134, the light barrier 50 and the fork-type light barrier 72 are connected to a control apparatus (not illustrated) which evaluates the signals supplied by the sensors and measuring devices and controls the drives of the various units, as is described hereinbelow.

In the separating module 96, individual banknotes 98 are drawn off from the banknote store 100 and transported individually by means of the transporting section 110, in the direction of the arrow B, through the thickness-measuring device 134 to the bottom end of the sheet conveyor 14, where they pass into the inlet gap 46. The stacking wheels 58 are positioned, relative to the sheet conveyor 14, in the position which is illustrated in FIG. 1 and in which a receiving gap 90 has its inlet end oriented in the direction of the outlet gap 44 of the sheet conveyor 14. A sheet 98 running through in the direction of the arrow A passes into the receiving gap 90 of the stacking wheels 58 which are arranged one beside the other. As soon as the trailing edge of the sheet or of the banknote 98 is detected by the light barrier 50, the drive motor 68 of the stacking-wheel drive is actuated with a time delay. The delay time is measured such that the stacking-wheel movement begins when the trailing edge of the banknote has left the outlet gap 44. The stacking wheels 58 are then rotated further by one receiving gap 90, i.e. in the present example through 90 in the clockwise direction (arrow C). The movement takes place here in a manner corresponding to a trapezoidal profile, with a steep accelerating section, a continuous movement and just as steep a braking flank.

With the high initial acceleration of the stacking wheels 58, an inwardly directed force component acts on the paddles 78 on account of the relatively high level of mass inertia of the paddles in their outer region, with the result that the receiving gaps 90 close. Although this only applies to the beginning of the movement, since at a later stage the centrifugal force pivots the paddles outward again, this brief snapping-shut movement of the paddles is nevertheless sufficient in order to secure, and carry along, a banknote which is located in the receiving gap 90. The banknotes 98 which are gripped by the stacking wheels 58 in this way are set down on a stacking surface in a conventional manner.

For the case where two or more banknotes 98 are drawn off in an overlapping position in the separating module 96, it being possible for this to be detected by the thickness-measuring device 134, the operating sequence is basically exactly the same as has been described above. The overlapping banknotes together run into a receiving gap 90 of the stationary stacking wheels 58, since the latter are only advanced when the light barrier 50 detects a trailing edge, which may be the trailing edge either of an individual banknote or of a group of overlapping banknotes. This does not depend on the arrangement in which the banknotes may possibly overlap, i.e. on whether the following banknotes are located above or beneath the respectively preceding banknote.

A different operation takes place, however, if the spacings between successive banknotes 98 are smaller than a predetermined minimum spacing. This means that the banknotes may also follow one after the other at such short time intervals that it is no longer possible for the stacking wheels 58 to be advanced into their next position in each case in this period of time. The spacings between successive banknotes may be determined with the aid of the light barrier 50, of some other light barrier or of the thickness-measuring device 134 and with the aid of the known or measured transporting speed of the sheet conveyor 14. If it is established that the spacing is smaller than the minimum spacing, then first of all the separating operation which is currently in progress in the separating module 96 is terminated and then the separating module 96 is brought to a standstill. Thereafter, the transporting speed of the sheet conveyor 14 is reduced until the preceding banknote 98 has left the outlet gap 44 of the sheet conveyor 14. The sheet conveyor 14 is then likewise brought to a standstill. The stacking-wheel arrangement may then be advanced until the next receiving gap 90 of the stacking wheels 58 is located opposite the outlet gap 44 of the sheet conveyor 14. After this, the sheet conveyor 14 is first of all accelerated to a fraction of its nominal speed, for example half the transporting speed, until it is possible to establish that the spacings between successive banknotes have reached the normal value again. After this, the separating module 96 is also brought into operation again.

What is claimed is:

1. A method of forming a bundle of individual sheets, in particular banknotes (98), said method comprising:

drawing off sheets individually from a sheet-storage container (100), feeding the drawn off sheets, via a sheet conveyor (14), to a stacking wheel arrangement comprising at least one stacking wheel (58), and setting down the drawn off sheets on a stacking surface by means of said stacking-wheel arrangement, said method also comprising the further steps of detecting the trailing edge of a sheet (98) leaving the sheet conveyor (14) at a predetermined location of the sheet conveyor (14), driving each stacking wheel (58) intermittently and controlling said driving so that a receiving gap (90) of a stacking wheel (58) is aligned with an outlet end (44) of the sheet conveyor (14) when a sheet (98) leaves the sheet conveyor (14), and so that a stacking wheel (58) is advanced by one receiving gap (90) in dependence on the time at which the trailing edge of a sheet leaving the sheet conveyor (14) is detected.

2. The method as claimed in claim 1, and further comprising detecting the spacing between a preceding sheet and a following sheet (98) within the sheet conveyor (14), when the detected spacing is smaller than a predetermined minimum spacing interrupting the drawing off of the sheets (98) individually from the sheet storage container (100) and reducing the transporting speed until the preceding sheet (98) has left the sheet conveyor (14), then stopping the drive of the sheet conveyor (14) until the preceding sheet (98) has run into a stacking wheel (58), and then after the stacking wheel (58) has advanced again switching on the drive of the sheet conveyor (14).

3. The method as claimed in claim 2, wherein when the drive of the sheet conveyor (14) is switched on again, controlling the drive so that the sheet conveyor is first of all accelerated only to a fraction of a nominal speed as long as the detected sheet spacings are smaller than the predetermined minimum spacing.

4. The method as claimed in claim 1, wherein the thickness of a sheet and the extent of a sheet in the transporting direction are detected in the region of the sheet conveyor.

5. An apparatus for forming a bundle of individual sheets, in particular banknotes (98), which are drawn off individually from a sheet-storage container (100), said apparatus comprising:

a separating apparatus (96) for drawing off sheets from a sheet-storage container (100), a sheet conveyor (14), a drive for the sheet conveyor, a stacking-wheel arrangement which is assigned to an outlet end (44) of the sheet conveyor (14) and has at least one stacking wheel (58) and a stacking-wheel drive (68), a detector device (50) which is arranged in the region of the sheet conveyor (14) and is intended for detecting an edge of a sheet (98) running through the sheet conveyor (14), and a control device which is connected to the separating apparatus (96), the drive of the sheet conveyor (14), the stacking-wheel drive (68) and the detector device (50), the stacking-wheel drive (68) being designed for intermittent operation, and the control device being programmed such that the stacking wheel (58) is stopped in a position in which the receiving gap (90) of the stacking wheel (58) is aligned with the outlet end (44) of the sheet conveyor (14) when a sheet (98) leaves the sheet conveyor (14) and wherein, in dependence on an output signal from the detector device (50), said signal corresponding to the trailing edge of a sheet (98) running into the receiving gap (90) of the stacking wheel (58) being detected, the stacking wheel (58) is advanced by one receiving gap (90).

6. The apparatus as claimed in claim 5, characterized in that a spacing-measuring device (50; 134) for detecting the spacing between two successive sheets (98) is arranged in the region of the sheet conveyor (14).

7. The apparatus as claimed in claim 5, characterized in that the detector device (50) comprises a light barrier, which is arranged in the vicinity of the outlet end of the sheet conveyor (14).

8. The apparatus as claimed in claim 5, characterized in that a thickness-measuring device (134) for detecting the thickness of the sheets (98) running through the sheet conveyor is arranged in the region of the sheet conveyor.

9. The apparatus as claimed in claim 8, characterized in that the thickness-measuring device (134) has a lever gauge (128) which is mounted such that it can be pivoted in relation to a rigid rest (124).

10. The apparatus as claimed in claim 5, characterized in that a length-measuring device for detecting the extent in the transporting direction of the sheets (98) running through the sheet conveyor (14) is provided in the region of the sheet conveyor (14).

11. The apparatus as claimed in claim 10, characterized in that the length-measuring device comprises at least one sensor for detecting a sheet edge, and also comprises an encoder which is coupled to the drive of the sheet conveyor.

12. The apparatus as claimed in claim 11, characterized in that the length-measuring device has at least two sensors which are spaced apart transversely to the transporting direction.

13. The apparatus as claimed in claim 5, characterized in that the stacking wheel (58) has a wheel hub (76) with more or less tangentially directed paddles (78) which are articulated resiliently on said wheel hub and of which in each case two adjacent paddles (78) form a receiving gap (90) for a sheet (98), the majority of the paddle mass being concentrated in the half (80) of the paddle (78), said half being in the vicinity of the free paddle end.

14. The apparatus as claimed in claim 13, characterized in that the stacking wheel (58) is produced in one piece from plastic.

15. The apparatus as claimed in claim 13, characterized in that an additional mass (94) is arranged in the vicinity of the free end of each paddle (78) of the stacking wheel (58), said additional mass being of a higher density than the stacking-wheel material.

16. The apparatus as claimed in claim 15, characterized in that the additional mass (94) consists of metal.

17. The apparatus as claimed in claim 13, characterized in that the paddles (78) bear a corrugated formation (92) on their mutually facing surfaces.

18. The apparatus as claimed in claim 13, characterized in that the stacking wheel (58) has four paddles (78) which are offset in each case through 90 in relation to one another.

19. The apparatus as claimed in claim 13, characterized in that the resilient deflection of the paddles (78) in the radially outward direction is limited in each case by a stop (86) which is connected rigidly to the hub (76).

20. The apparatus as claimed in claim 5, characterized in that the drive of the stacking wheel (58) is a stepping motor (68).

* * * * *